US009859622B2

(12) United States Patent
Sato et al.

(10) Patent No.: US 9,859,622 B2
(45) Date of Patent: Jan. 2, 2018

(54) ARRAY ANTENNA

(71) Applicant: Panasonic Corporation, Osaka (JP)

(72) Inventors: Junji Sato, Tokyo (JP); Ryosuke Shiozaki, Tokyo (JP)

(73) Assignee: Panasonic Corporation, Osaka (JP)

( * ) Notice: Subject to any disclaimer, the term of this patent is extended or adjusted under 35 U.S.C. 154(b) by 45 days.

(21) Appl. No.: 14/996,090

(22) Filed: Jan. 14, 2016

(65) Prior Publication Data

US 2016/0240934 A1 Aug. 18, 2016

(30) Foreign Application Priority Data

Feb. 18, 2015 (JP) ..... 2015-029660

(51) Int. Cl.

| | |
|---|---|
| ***H01Q 21/00*** | (2006.01) |
| ***H01Q 7/00*** | (2006.01) |
| ***H01Q 13/20*** | (2006.01) |
| ***H01Q 9/04*** | (2006.01) |

(52) U.S. Cl.

CPC ..... *H01Q 21/0075* (2013.01); *H01Q 7/00* (2013.01); *H01Q 9/0457* (2013.01); *H01Q 9/0464* (2013.01); *H01Q 13/20* (2013.01); *H01Q 13/206* (2013.01); *H01Q 21/0037* (2013.01)

(58) Field of Classification Search

CPC ..... H01Q 7/00; H01Q 13/20; H01Q 21/0075; H01Q 21/0037; H01Q 9/0457; H01Q 9/0464; H01Q 21/23

See application file for complete search history.

(56) References Cited

U.S. PATENT DOCUMENTS

| | | | | |
|---|---|---|---|---|
| 8,497,814 | B2 * | 7/2013 | Puente | H01Q 1/246 343/700 MS |
| 2010/0026584 | A1 * | 2/2010 | Nakabayashi | H01Q 21/065 343/700 MS |
| 2012/0262359 | A1 | 10/2012 | Baliarda et al. | |
| 2013/0222204 | A1 * | 8/2013 | Binzer | G01S 7/03 343/853 |
| 2014/0333502 | A1 | 11/2014 | Uno et al. | |

FOREIGN PATENT DOCUMENTS

| | | | | |
|---|---|---|---|---|
| GB | 2064877 A | * | 6/1981 | H01Q 11/105 |
| JP | 2001-044752 | | 2/2001 | |
| WO | 2014/045519 | | 3/2014 | |

OTHER PUBLICATIONS

Shau-gang Mao, "Characterization and Modeling of Left-Handed Microstrip Lines With Application to Loop Antennas", Apr. 2006, IEEE, vol. 54, No. 4, pp. 1084-1091.*

Extended European Search Report, dated Jun. 15, 2016, for corresponding to EP Application No. 16151165.4-1812, 7 pages.

* cited by examiner

*Primary Examiner* — Dieu H Duong

(74) *Attorney, Agent, or Firm* — Seed IP Law Group LLP

(57) ABSTRACT

An array antenna includes: a feed line provided on a first surface of a substrate; a plurality of antenna elements that are provided on the first surface at predetermined gap along the feed line and that are electromagnetically coupled with the feed line; and a conductor plate that is provided on a second surface of the substrate different from the first surface and that is ground for the feed line and the plurality of antenna elements, the plurality of antenna elements including a first antenna element having a shape that resonates at a first frequency and a second antenna element having a shape that resonates at a second frequency different from the first frequency.

12 Claims, 9 Drawing Sheets

ARRAY ANTENNA

BACKGROUND

1. Technical Field

The present disclosure relates to an array antenna that radiates a radio wave.

2. Description of the Related Art

An example of an array antenna used for wireless communication system or radar application is an array antenna having a microstrip structure.

For example, Japanese Patent No. 3306592 discloses a microstrip array antenna that includes a plurality of rectangular antenna elements disposed along a linear feed line. Each of the plurality of rectangular antenna elements is connected to the feed line in a direction inclined with respect to the feed line.

In general, it is necessary to suppress unnecessary radiation (side lobe) of a radiated wave in an array antenna. In order to suppress side lobe, a distribution of amplitudes of a plurality of antenna elements constituting the array antenna by weighting the amplitudes of the antenna elements. For example, the amount of radiation of an antenna element in the vicinity of the center is made large, and the amount of radiation of an antenna element is made smaller as the distance from the center becomes larger. For example, the amount of radiation of an antenna element close to an end need to be adjusted to a low amount of radiation of approximately 1% to 2% of the whole amount of radiation from all of the antenna elements in order to make the side lobe lower by 20 dB than a radio wave in a desired radiation direction. In the following description, the amount of radiation relative to the whole amount of radiation from all of the antenna elements is expressed by percentage.

However, in the conventional art of Japanese Patent No. 3306592, the width of each of the plurality of rectangular antenna elements need be set to not more than 50 μm in order to reduce the amount of radiation of the antenna element to approximately 1% to 2%. However, it is difficult to produce an antenna element whose width is not more than 50 μm with pattern etching accuracy in general substrate processing.

SUMMARY

One non-limiting and exemplary embodiment provides an array antenna in which the amount of radiation of an antenna element is adjusted by adjusting the resonant frequency of the antenna element so that side lobe of a radiated wave can be suppressed.

In one general aspect, the techniques disclosed here feature an array antenna including: a feed line provided on a first surface of a substrate; and a plurality of antenna elements that are provided on the first surface at predetermined gap along the feed line and that are electromagnetically coupled with the feed line, the plurality of antenna elements including a first antenna element having a shape that resonates at a first frequency and a second antenna element having a shape that resonates at a second frequency different from the first frequency.

According to one aspect of the present disclosure, the amount of radiation of an antenna element can be adjusted by adjusting the resonant frequency of the antenna element, and thereby side lobe of the radiated wave can be suppressed.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Underlying Knowledge Forming Basis of the Present Disclosure

First, underlying knowledge forming the basis of the present disclosure is described.

Figure 1:
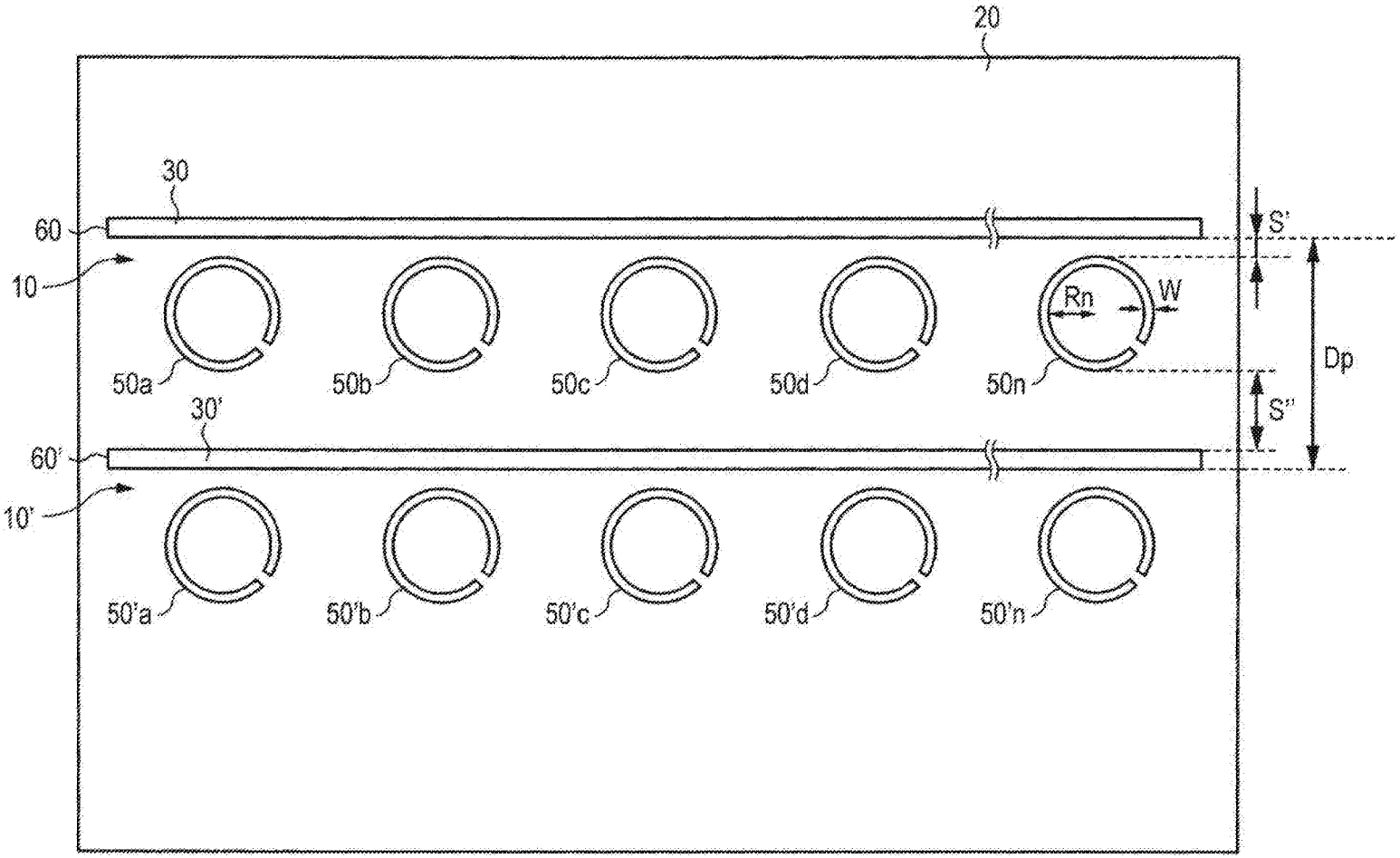
FIG. 1 illustrates an example of a configuration in which a plurality of general array antennas are disposed.

FIG. 1 illustrates an example of a configuration in which a plurality of general array antennas are disposed. The array antenna 10 illustrated in FIG. 1 includes a feed line 30, a plurality of antenna elements 50*a* through 50*n*, and an input port 60. FIG. 1 illustrates an example in which an array antenna 10' having the same configuration as the array antenna 10 is provided on one surface of a substrate 20 apart by a gap Dp from the array antenna 10.

The substrate 20 is, for example, a double-sided copper-clad substrate. The feed line 30 constitutes a microstrip line with a conductor plate (not illustrated) formed on the other surface of the substrate 20. The feed line 30 is linear and formed from a copper foil pattern or the like that has a line width achieving a predetermined characteristic impedance.

Each of the antenna elements 50*a* through 50*n* is a loop-shaped element having a cutout part. The antenna elements 50*a* through 50*n* are disposed along the feed line 30 at regular gap. More specifically, the antenna elements 50*a* through 50*n* are disposed so that the centers of the loop shapes of the antenna elements 50*a* through 50*n* are located along the feed line 30 at regular gap. Each of the antenna elements 50*a* through 50*n* has a width W.

Each of the antenna elements 50*a* through 50*n* is provided away by an gap S' from the feed line 30 and is electromagnetically coupled with the feed line 30. The feed line 30 supplies an electric current to the antenna elements 50*a* through 50*n* by electromagnetic coupling with the antenna elements 50*a* through 50*n*. The amount of radiation of each of the antenna elements 50*a* through 50*n* is controlled by adjusting the gap S' between each of the antenna elements 50*a* through 50*n* and the feed line 30.

The loop shapes of the antenna elements 50*a* through 50*n* are adjusted so that the antenna elements 50*a* through 50*n* resonate at a desired frequency. For example, in a case where the desired frequency is 79 GHz, which is a frequency of a radiated wave, a radius Rn of an inner periphery of each of the antenna elements 50*a* through 50*n* is set to approximately 0.48 mm.

The array antenna 10 illustrated in FIG. 1 obtains a radiated wave of a desired beam pattern by controlling the amount of radiation through adjustment of the gap S' between the feed line 30 and each of the antenna elements 50*a* through 50*n*.

Figure 2:
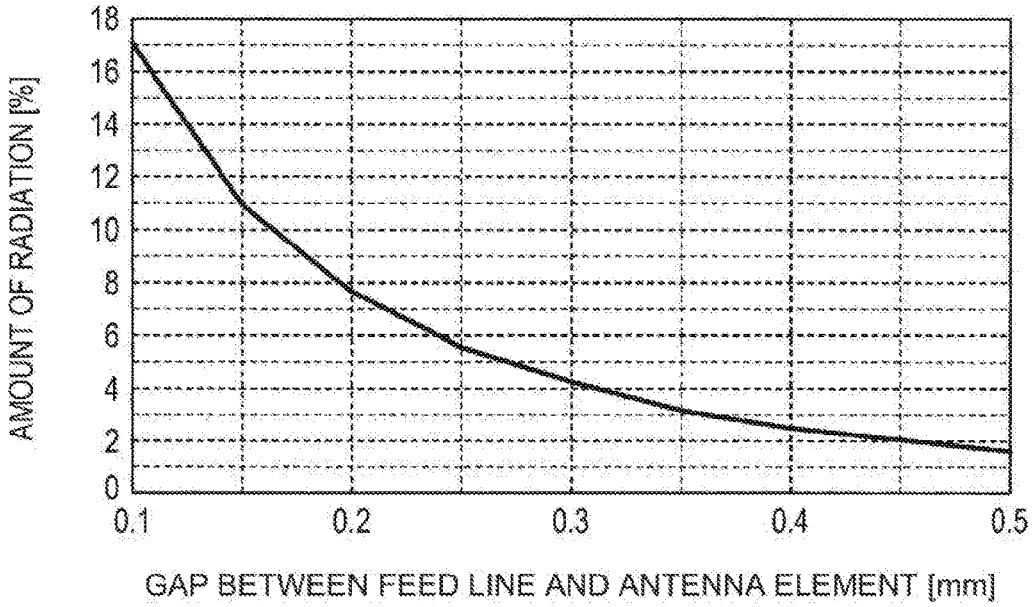
FIG. 2 illustrates a relationship between (i) a gap between a feed line and an antenna element and (ii) the amount of radiation.

FIG. 2 is a diagram illustrating a relationship between (i) the gap S' between the feed line 30 and each of the antenna elements 50*a* through 50*n* and (ii) the amount of radiation. In FIG. 2, the horizontal axis represents the gap S' between the feed line 30 and each of the antenna elements 50*a* through 50*n*, and the vertical axis represents the amount of radiation.

As illustrated in FIG. 2, the amount of radiation becomes smaller as the gap S' becomes larger. When the gap S' is approximately 0.5 mm, the amount of radiation is not more than 2%.

Meanwhile, in the configuration illustrated in FIG. 1, the gap Dp between the feed line 30 and a feed line 30' need be set to an approximately half-wavelength of the wavelength of the radiated wave in order to suppress a grating lobe that occurs due to interference between radio waves radiated by the two array antenna 10 and 10'.

For example, in a case where the frequency of the radiated wave is 79 GHz, the half-wavelength is approximately 1.9 mm. That is, in the configuration illustrated in FIG. 1, when the radiated frequency is 79 GHz, the gap Dp need be set to approximately 1.9 mm.

As described above, in the configuration illustrated in FIG. 1, in a case where a radio wave having a frequency of 79 GHz is radiated, the gap Dp need be set to approximately 1.9 mm, and the radius of each of the antenna elements 50*a* through 50*n* need be set to approximately 0.48 mm. In this case, for example, in a case where the gap S' between the antenna element 50*a* and the feed line 30 is set to approximately 0.5 mm in order to adjust the amount of radiation of the antenna element 50*a* to not more than 2%, an gap S" between the antenna element 50*a* and the feed line 30' of the array antenna 10' is 0.24 mm assume that the width W of the antenna element is 0.1 mm. That is, in this configuration, coupling between the antenna element 50*a* and the feed line 30' is stronger than that between the antenna element 50*a* and the feed line 30 in a case where the amount of radiation of the antenna element 50*a* is adjusted to not more than 2%.

Meanwhile, in a case where the gap S' is set to 0.3 mm or less in order to make coupling between the antenna element 50*a* and the feed line 30' weaker than that between the antenna element 50*a* and the feed line 30, it is difficult to adjust the amount of radiation of the antenna element to not more than 4% as illustrated in FIG. 2.

The amount of radiation of an antenna element can be adjusted by employing a shape of the antenna element so that the resonant frequency of the antenna element is deviated from a desired frequency. Based on this, the present disclosure was accomplished.

Embodiment 1

Embodiment 1 of the present disclosure is described in detail below with reference to the drawings. Note that the embodiments described below are examples, and the present disclosure is not limited to these embodiments.

Figure 3A:
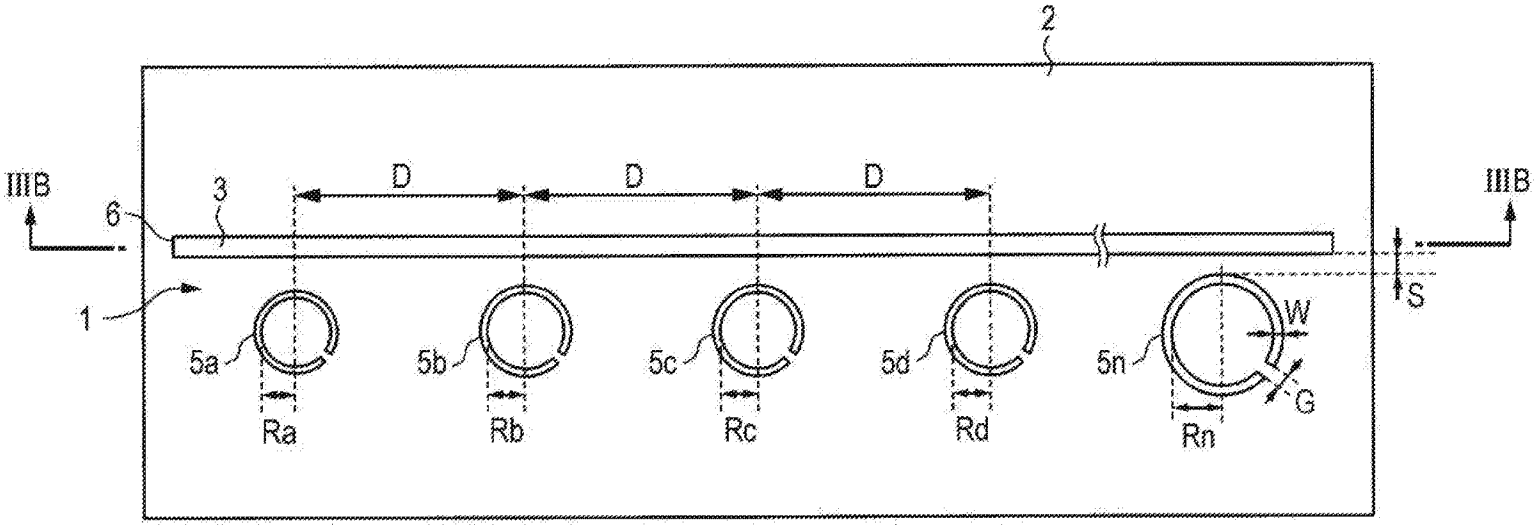
FIGS. 3A and 3B illustrate an example of an array antenna according to Embodiment 1 of the present disclosure.
Figure 3B:
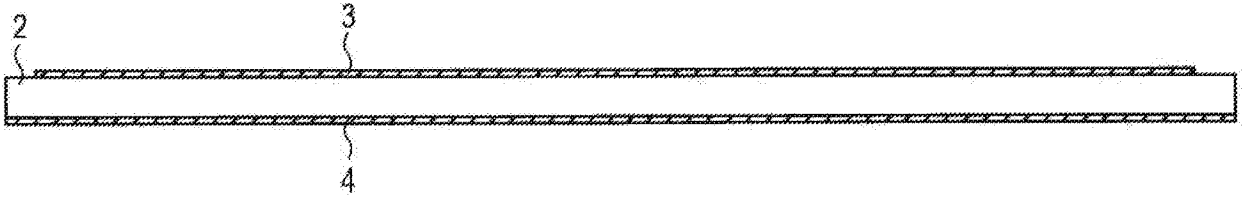

FIGS. 3A and 3B illustrate an example of an array antenna 1 according to Embodiment 1 of the present disclosure. FIG. 3A is a plan view of the array antenna 1, and FIG. 3B is a cross-sectional view taken along the line IIIB-IIIB in FIG. 3A.

The array antenna 1 illustrated in FIGS. 3A and 3B includes a substrate 2, a feed line 3, a conductor plate 4, a plurality of antenna elements 5*a* through 5*n*, and an input terminal 6.

The substrate 2 is, for example, a double-sided copper-clad substrate. The feed line 3 is formed from a copper foil pattern or the like on one surface of the substrate 2. The conductor plate 4 is formed on a surface of the substrate 2 opposite to the surface on which the feed line 3 is formed. The conductor plate 4 is ground for the feed line 3 and the antenna elements 5*a* through 5*n*. The feed line 3 and the conductor plate 4 constitute a microstrip line.

The input terminal 6 is a feeding point of the array antenna 1. An electric current fed from the input terminal 6 flows through the feed line 3 and is supplied from the feed line 3 to the antenna elements 5*a* through 5*n*.

The antenna elements 5*a* through 5*n* are disposed at regular gap D along the feed line 3 on the surface of the substrate 2 on which the feed line 3 is formed. Each of the antenna elements 5*a* through 5*n* is a loop-shaped element having a cutout part. More specifically, the antenna elements 5*a* through 5*n* are disposed so that the centers of the loop shapes of the antenna elements 5*a* through 5*n* are located at the regular gap D along the feed line 3.

The length of the outer periphery of each of the antenna elements 5*a* through 5*n* is approximately 1 wavelength of the resonant frequency thereof. That is, the radius of each of the antenna elements 5*a* through 5*n* varies depending on the resonant frequency.

Each of the antenna elements 5*a* through 5*n* has a cutout part having a width G in a circumferential direction of the loop. The cutout part is located so that an angle formed by (i) a straight line connecting the center of the antenna element and a substantial center of the cutout part and (ii) the feed line 3 is 45 degrees.

Note that the position of the cutout part of each of the antenna elements 5*a* through 5*n* is not limited to this.

Each of the antenna elements 5*a* through 5*n* is provided away by an gap S from the feed line 3 and is electromagnetically coupled with the feed line 3. The feed line 3 supplies an electric current to the antenna elements 5*a* through 5*n* by electromagnetic coupling with the antenna elements 5*a* through 5*n*. The amount of radiation of each of the antenna elements 5*a* through 5*n* is controlled by adjusting the gap S between each of the antenna elements 5*a* through 5*n* and the feed line 3.

The radii of the antenna elements 5*a* through 5*n* from the centers to the inner peripheries thereof are Ra through Rn. A frequency at which each of the antenna elements 50*a* through 50*n* resonates is determined by the radius of the loop shape of the antenna element.

In the present embodiment, the array antenna 1 radiates a radio wave of a desired beam pattern whose side lobe is suppressed by adjusting the amount of radiation of the antenna elements 5*a* through 5*d* located closer to the input terminal 6 to an amount lower than that of the antenna element 5*n* located farther from the input terminal 6. A method for adjusting the amount of radiation of the antenna elements 5*a* through 5*d* is described below.

The shape of the antenna element 5*n* (hereinafter referred to as a first antenna element) located farther from the input terminal 6 than the antenna element 5*d* among the antenna elements 5*a* through 5*n* is adjusted so that the resonant frequency thereof becomes a frequency (hereinafter referred to as a first frequency) of a radiated wave. Meanwhile, the shape of each of the antenna elements 5*a* through 5*d* (hereinafter referred to as a second antenna element) located closer to the input terminal 6 is adjusted so that the resonant frequency thereof becomes a frequency (hereinafter referred to as a second frequency) that is different by Δf from the first frequency.

Specifically, as illustrated in FIG. 3A, the radius of the second antenna element (i.e., the radii Ra through Rd of the antenna elements 5*a* through 5*d*) is made smaller than that of the first antenna element (i.e., the radius Rn of the antenna element 5*n*). This causes the second frequency to be higher by Δf (>0) than the first frequency.

With the arrangement, the amount of radiation of the second antenna element is adjusted to a low amount of radiation of not more than 2%. The following describes a relationship between the radius Ra of the antenna element 5*a* as an example of the second antenna element and the amount of radiation.

Figure 4:
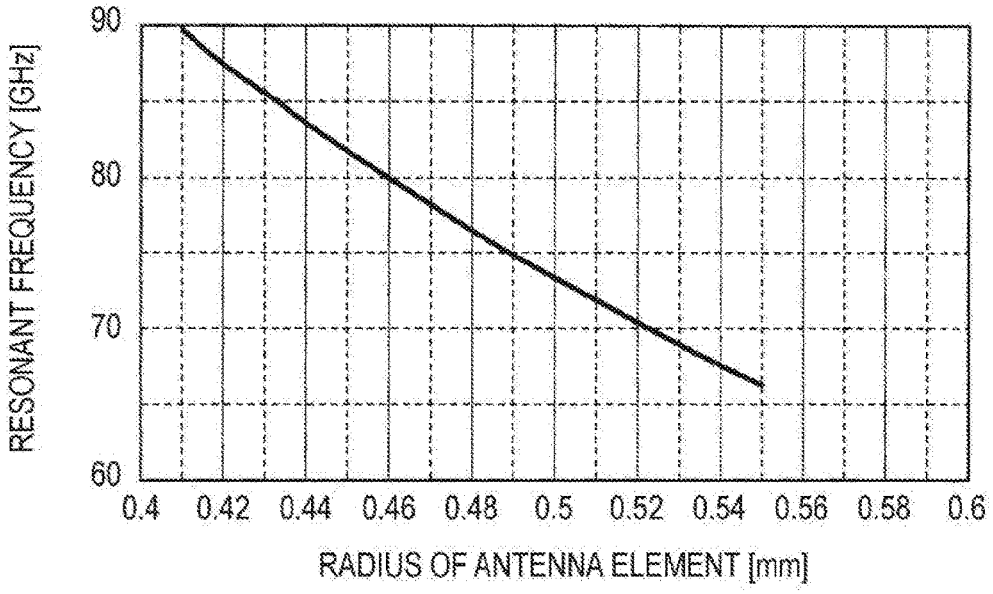
FIG. 4 illustrates a relationship between the radius of an antenna element and the resonant frequency of the antenna element.

FIG. 4 illustrates a relationship between the radius Ra of the antenna element 5*a* and the resonant frequency of the antenna element 5*a*. In FIG. 4, the horizontal axis represents the radius Ra, and the vertical axis represents the resonant frequency. As illustrated in FIG. 4, the resonant frequency of the antenna element 5*a* can be changed by adjusting the radius Ra of the antenna element 5*a*.

Figure 5:
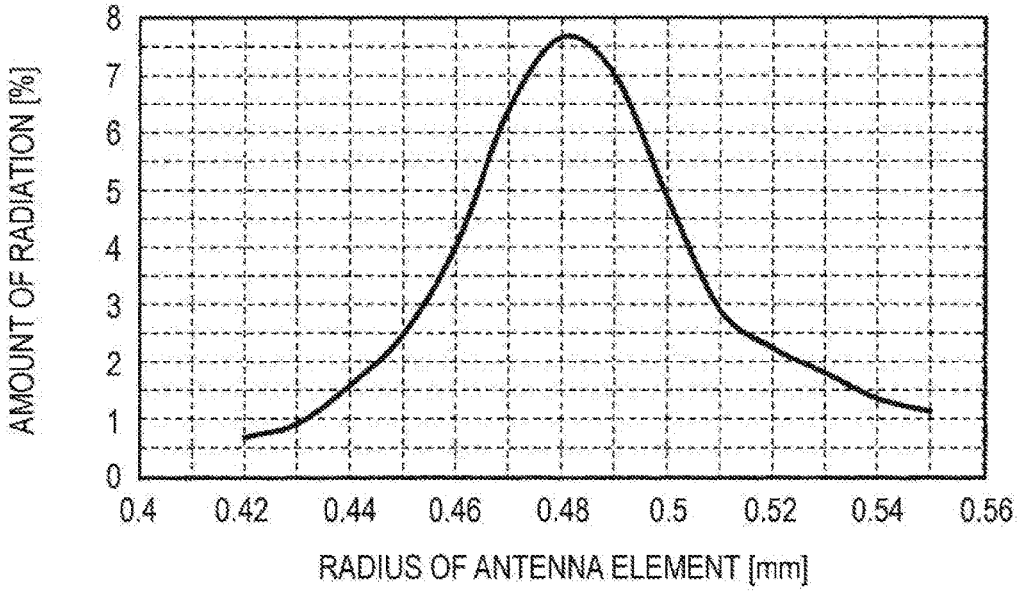
FIG. 5 illustrates a relationship between the radius of an antenna element and the amount of radiation of the antenna element.

FIG. 5 illustrates a relationship between the radius Ra of the antenna element 5*a* and the amount of radiation of the antenna element 5*a*. In FIG. 5, the horizontal axis represents the radius Ra as in FIG. 4, and the vertical axis represents the amount of radiation. The amount of radiation illustrated in FIG. 5 is the amount of radiation relative to the radius obtained in a case where an electric current for radiation of a radio wave of 79 GHz is fed from the input terminal 6 and the gap S between the feed line 3 and the antenna element 5*a* is adjusted so that the maximum amount of radiation becomes approximately 7.7%.

As illustrated in FIGS. 4 and 5, the amount of radiation of the antenna element 5*a* can be adjusted by adjusting the radius Ra of the antenna element 5*a* and thereby changing the resonant frequency. For example, a low amount of radiation of not more than approximately 2% can be obtained by setting the radius to 0.45 mm or less as illustrated in FIG. 5.

Similarly, the amount of radiation of each of the antenna elements 5*b* through 5*d* can be made low by adjusting the radius thereof.

As described above, the amount of radiation of the second antenna element can be adjusted to a low amount of radiation by making the radius of the second antenna element smaller than that of the first antenna element and thereby changing the resonant frequency of the second antenna element. With the arrangement, the array antenna 1 illustrated in FIGS. 3A and 3B can radiate a radio wave of a desired beam pattern whose side lobe is suppressed.

In the configuration illustrated in FIGS. 3A and 3B, the antenna elements 5*a* through 5*d* have the same shape, but the antenna elements 5*a* through 5*d* may have different resonant frequencies, i.e., may have different radii.

As illustrated in FIG. 4, a low amount of radiation of not more than 2% can also be obtained by adjusting the radius to not less than 0.53 mm. The following describes an arrangement in which the radius of the second antenna element is made larger.

Figure 6A:
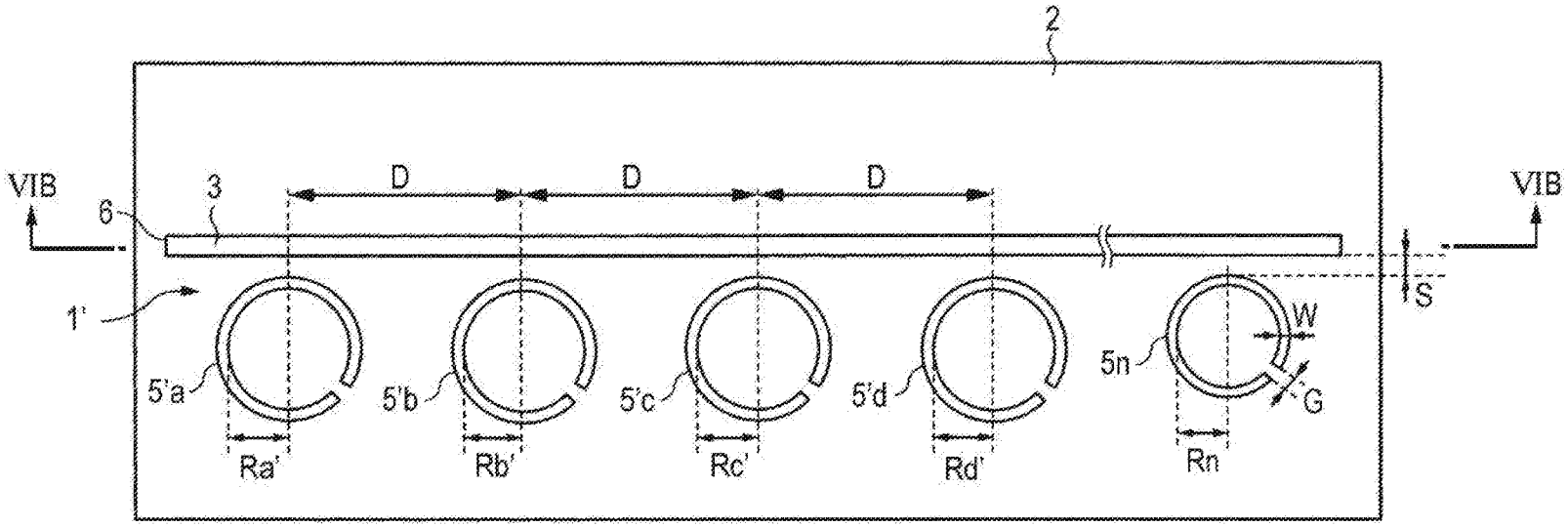
FIGS. 6A and 6B illustrate another example of the array antenna according to Embodiment 1 of the present disclosure.
Figure 6B:
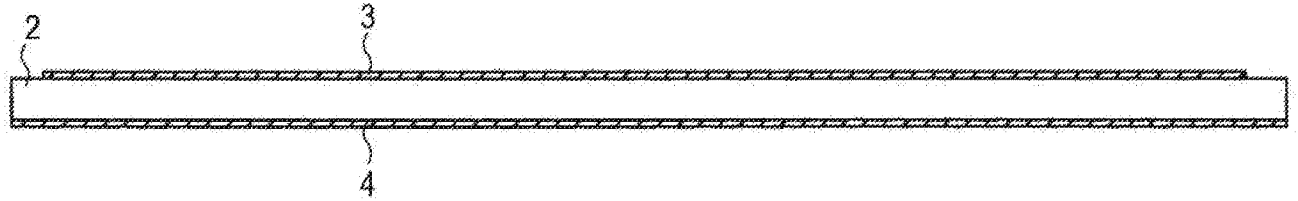

FIGS. 6A and 6B illustrate another example of an array antenna 1' according to Embodiment 1 of the present disclosure. FIG. 6A is a plan view of the array antenna 1', and FIG. 6B is a cross-sectional view taken along the line VIB-VIB in FIG. 6A.

In FIGS. 6A and 6B, elements that are identical to those in FIGS. 3A and 3B are given identical reference numerals, and detailed description thereof is omitted. Antenna elements 5'*a* through 5'*d* of the array antenna 1' illustrated in FIGS. 6A and 6B are different from the antenna elements 5*a* through 5*d* in FIG. 3A.

Each of the antenna elements 5'*a* through 5'*d* has a loop shape having a cutout part as with the antenna elements 5*a* through 5*d* illustrated in FIG. 3A. The antenna elements 5'*a* through 5'*d* are located at the same positions as the antenna elements 5*a* through 5*d*. The radii Ra' through Rd' of the antenna elements 5'*a* through 5'*d* are different from the radii Ra through Rd of the antenna elements 5*a* through 5*d*.

Each of the antenna elements 5'*a* through 5'*d* is a second antenna element in the array antenna 1'. In the configuration illustrated in FIGS. 6A and 6B, the radius of the second antenna element is larger than that of a first antenna element (a radius Rn of an antenna element 5*n*). That is, in the configuration illustrated in FIGS. 6A and 6B, the second frequency is lower by Δf (>0) than the first frequency.

In the configuration illustrated in FIGS. 6A and 6B, the amount of radiation of the second antenna element can be adjusted to a low amount of radiation by making the radius of the second antenna element larger than that of the first antenna element and thereby changing the resonant frequency of the second antenna element. With the arrangement, the array antenna 1' illustrated in FIGS. 6A and 6B can radiate a radio wave of a desired beam pattern whose side lobe is suppressed.

In Embodiment 1 described above, a case where the amount of radiation of an antenna element is adjusted by adjusting the radius of the antenna element and thereby changing the resonant frequency has been described. In the present embodiment, the amount of radiation of an antenna element can also be adjusted by adjusting a size other than the radius of the antenna element and thereby changing the resonant frequency.

Variation 1

Figure 7:
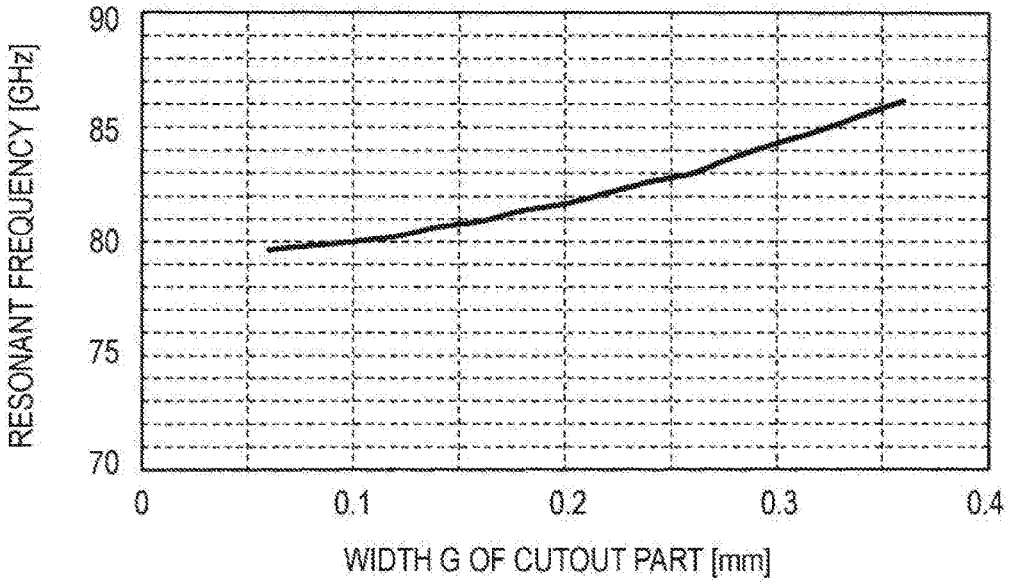
FIG. 7 illustrates a relationship between the width of a cutout part of an antenna element and the resonant frequency of the antenna element.

FIG. 7 illustrates a relationship between a width G of a cutout part of an antenna element (a length in a circumferential direction of a loop) and a resonant frequency of the antenna element. In FIG. 7, the horizontal axis represents the width G of the cutout part of the antenna element, and the vertical axis represents the resonant frequency. As illustrated in FIG. 7, the resonant frequency of the antenna element can be changed by adjusting the width G of the cutout part of the antenna element.

Figure 8:
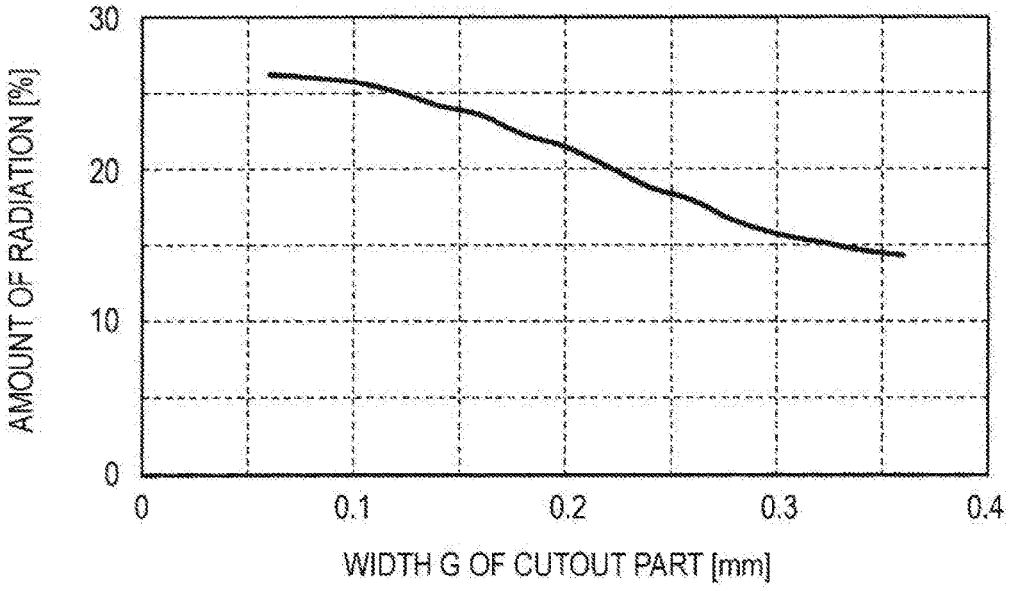
FIG. 8 illustrates a relationship between the width of a cutout part of an antenna element and the amount of radiation of the antenna element.

FIG. 8 illustrates a relationship between the width G of the cutout part of the antenna element and the amount of radiation of the antenna element. In FIG. 8, the horizontal axis represents the width G of the cutout part of the antenna element as in FIG. 7, and the vertical axis represents the amount of radiation of the antenna element.

As illustrated in FIGS. 7 and 8, the amount of radiation of the antenna element can be adjusted by adjusting the width G of the cutout part of the antenna element and thereby changing the resonant frequency. Therefore, similar effects can also be obtained by adjustment of the width G of the cutout part of the antenna element instead of adjustment of the radius of the antenna element. Furthermore, it is possible to increase flexibility of design by adjusting not only the radius of the antenna element but also the width G of the cutout part of the antenna element.

Variation 2

Figure 9:
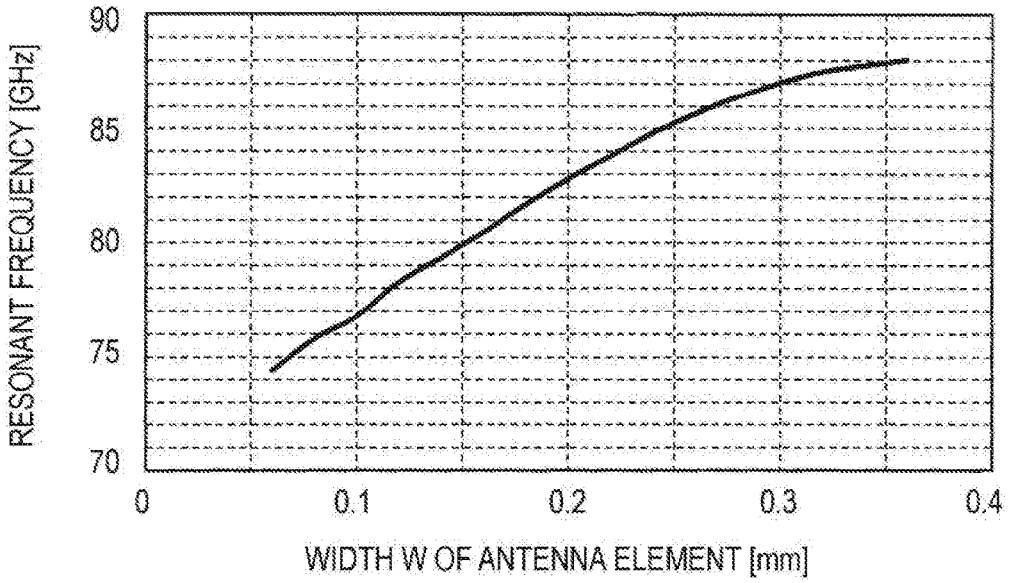
FIG. 9 illustrates a relationship between the width of an antenna element and the resonant frequency of the antenna element.

FIG. 9 illustrates a relationship between a width W of an antenna element in a radius direction of the loop and a resonant frequency of the antenna element. In FIG. 9, the horizontal axis represents the width W of the antenna element in a case where the length from the center to the inner periphery (radius) of the antenna element is fixed, and the vertical axis represents the resonant frequency of the antenna element. As illustrated in FIG. 9, the resonant frequency of the antenna element can be changed by adjusting the width of the antenna element.

Figure 10:
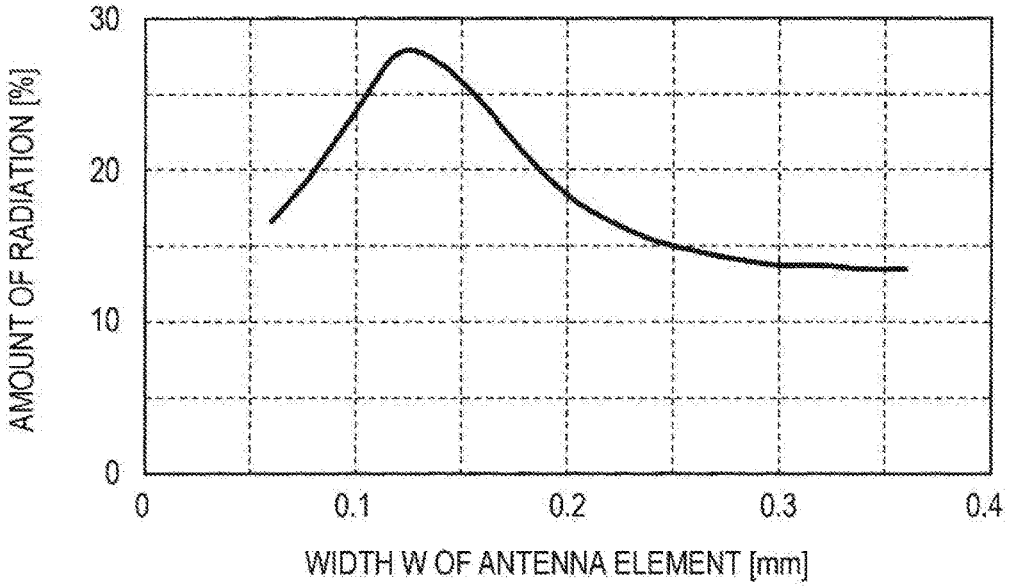
FIG. 10 illustrates a relationship between the width of an antenna element and the amount of radiation of the antenna element.

FIG. 10 illustrates a relationship between the width W of the antenna element and the amount of radiation of the antenna element. In FIG. 10, the horizontal axis represents the width W of the antenna element as in FIG. 9, and the vertical axis represents the amount of radiation of the antenna element.

As illustrated in FIGS. 9 and 10, the amount of radiation of the antenna element can be adjusted by adjusting the width W of the antenna element and thereby changing the resonant frequency. Therefore, similar effects can also be obtained by adjustment of the width W of the antenna element instead of adjustment of the radius of the antenna element or adjustment of the width G of the cutout part of the antenna element. Furthermore, it is possible to increase flexibility of design by adjusting not only the radius of the antenna element and/or the width G of the cutout part of the antenna element, but also the width W of the antenna element.

As described above, in the present embodiment, the amount of radiation of a loop-shaped antenna element having a cutout part can be adjusted to a low amount of radiation by adjusting the radius of the antenna element, the width of the cutout part in a circumferential direction, or the width of the antenna element in the radius direction and thereby changing the resonant frequency. Furthermore, in the present embodiment, two or more of the radius of the antenna element, the width of the cutout part of the antenna element in the circumferential direction, and the width of the antenna element in the radius direction may be adjusted. Flexibility of design of the antenna element is improved by adjusting two or more of the radius of the antenna element, the width of the cutout part of the antenna element in the circumferential direction, and the width of the antenna element in the radius direction.

In the present embodiment, the shape of the antenna element is adjusted so that the resonant frequency thereof becomes a frequency different from a desired frequency in order to obtain a low amount of radiation of not more than approximately 2%. Since the amount of radiation of a radio wave radiated from the antenna element whose shape has been adjusted is low, contribution of the radio wave radiated from the antenna element whose shape has been adjusted to a radio wave radiated from the whole array antenna is small. Accordingly, even in a case where the shape of the antenna element has been adjusted so that the resonant frequency thereof becomes a frequency different from a desired frequency, the influence of the radio wave radiated from the antenna element whose shape has been adjusted on the frequency characteristics of the radio wave radiated from the whole array antenna is small.

Embodiment 2

In Embodiment 1, an arrangement in which either an antenna element whose resonant frequency is higher by Δf than a frequency of a radiated wave or an antenna element whose resonant frequency is lower by Δf than the frequency of the radiated wave is provided has been described. In the present Embodiment 2, an arrangement in which both of the antenna element whose resonant frequency is higher by Δf than the frequency of the radiated wave and the antenna element whose resonant frequency is lower by Δf than the frequency of the radiated wave are provided is employed.

Figure 11A:
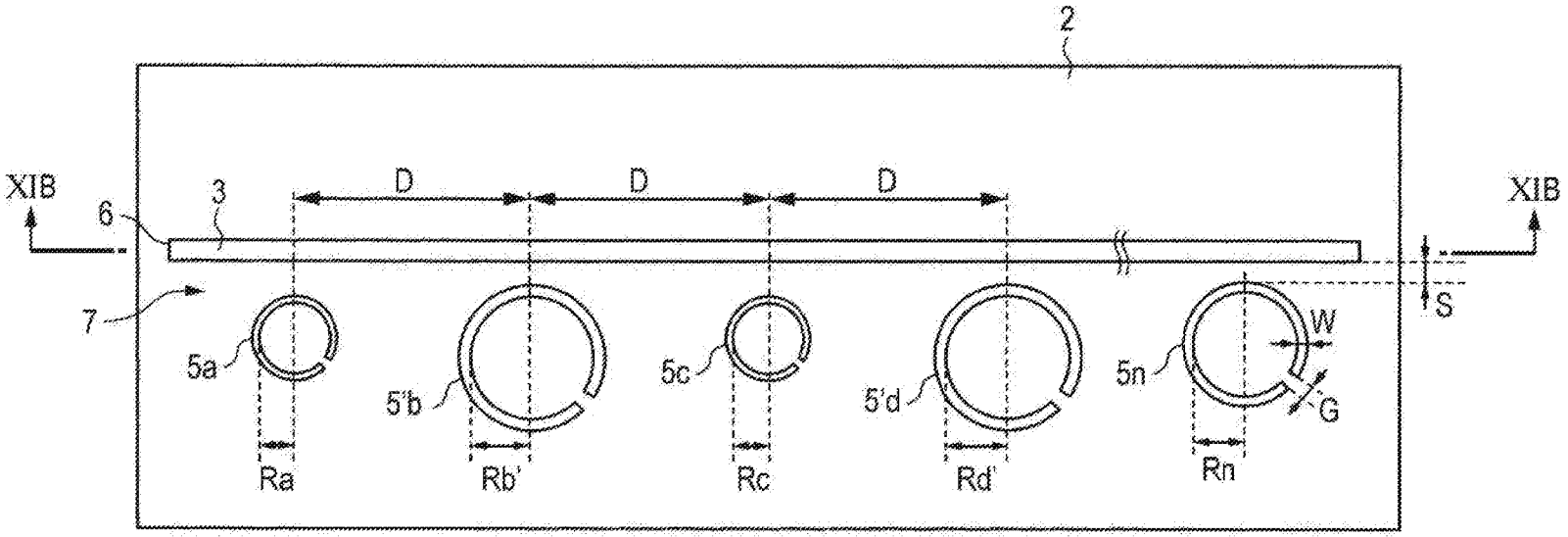
FIGS. 11A and 11B illustrate an example of an array antenna according to Embodiment 2 of the present disclosure.
Figure 11B:
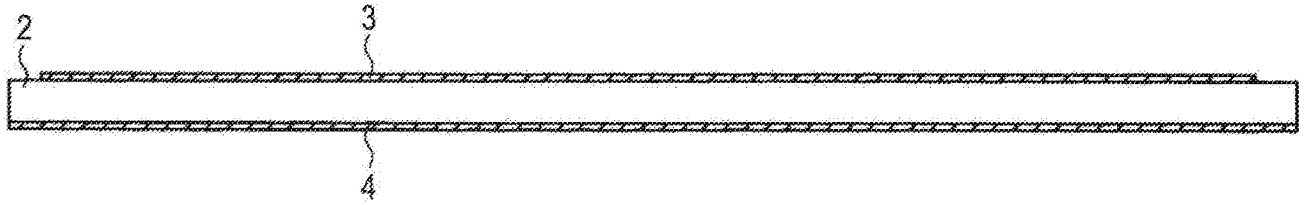

FIGS. 11A and 11B are diagrams illustrating an example of a configuration of an array antenna 7 according to Embodiment 2 of the present disclosure. FIG. 11A is a plan view of the array antenna 7, and FIG. 11B is a cross-sectional view taken along the line XIB-XIB in FIG. 11A.

Elements identical to those in FIGS. 3A and 3B are given identical reference numerals, and detailed description thereof is omitted. Four antenna elements 5*a*, 5'*b*, 5*c*, and 5'*d* provided close to an input terminal 6 in the array antenna 7 illustrated in FIGS. 11A and 11B are different from those in FIGS. 3A and 6A.

In the following description, an antenna element that resonates at a second frequency that is higher by Δf than a frequency (first frequency) of a radiated wave is a second antenna element, and an antenna element that resonates at a third frequency that is lower by Δ'f than the frequency (first frequency) of the radiated wave is a third antenna element. The first frequency is a frequency between the second frequency and the third frequency, and an absolute value Δf of a difference between the first frequency and the second frequency can be substantially equal to an absolute value Δ'f between the first frequency and the third frequency.

That is, in the present embodiment, the antenna elements 5*a* and 5*c* whose radii are smaller than a radius Rn of an antenna element 5*n* are the second antenna element, and the antenna elements 5'*b* and 5'*d* whose radii are larger than the radius Rn of the antenna element 5*n* are the third antenna element.

In the array antenna 7 illustrated in FIGS. 11A and 11B, the second antenna element and the third antenna element are alternately provided at positions close to the input terminal 6.

The amounts of radiation of the second antenna element and the third antenna element are adjusted to low amounts as described in Embodiment 1. That is, the array antenna 7 illustrated in FIGS. 11A and 11B can radiate a radio wave of a desired beam pattern whose side lobe is suppressed as in the array antenna illustrated in FIGS. 3A, 3B, 6A and 6B of Embodiment 1.

The array antenna 7 includes the second antenna element that resonates at a frequency (the second frequency) that is higher by Δf than the frequency (the first frequency) of the radiated wave and the third antenna element that resonates at a frequency (the third frequency) that is lower by Δf than the frequency (the first frequency) of the radiated wave. According to the configuration, the frequency characteristics of the second antenna element and the frequency characteristics of the third antenna element offset each other. It is therefore possible to further reduce the influence of radio waves radiated from the second antenna element and the third antenna element on the frequency characteristics of radio waves radiated from the whole array antenna.

In the array antenna 7 illustrated in FIGS. 11A and 11B, the second antenna element and the third antenna element are alternately provided at positions close to the input terminal 6. However, the present embodiment is not limited to this.

Figure 12A:
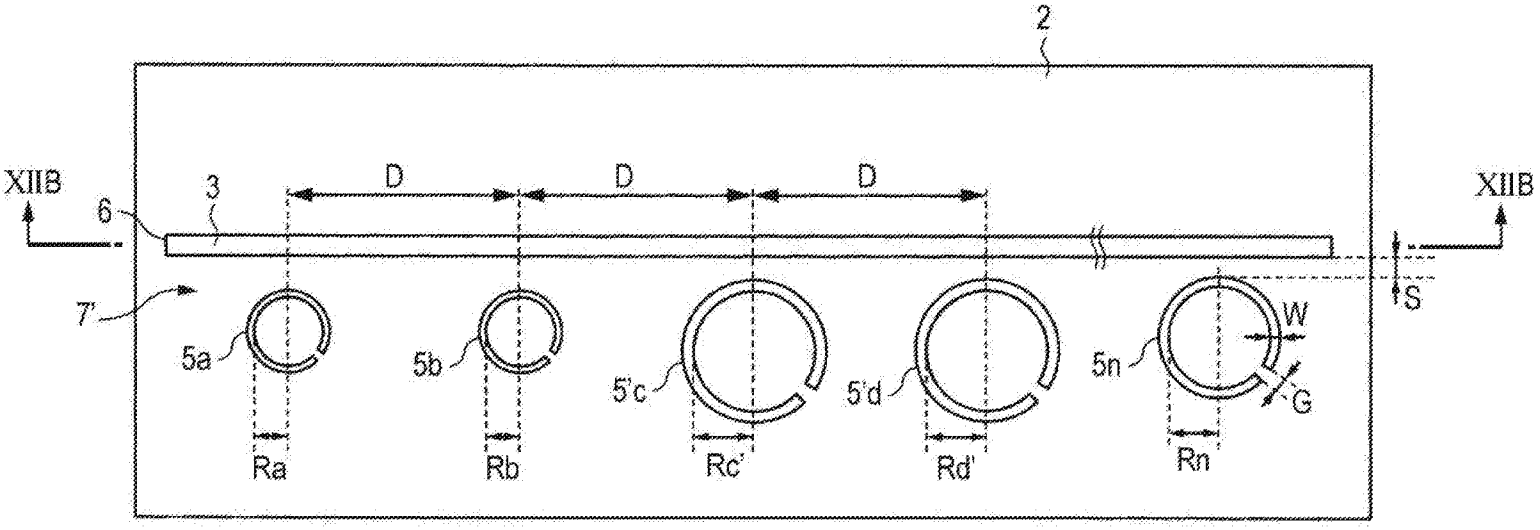
FIGS. 12A and 12B illustrate another example of the array antenna according to Embodiment 2 of the present disclosure.
Figure 12B:
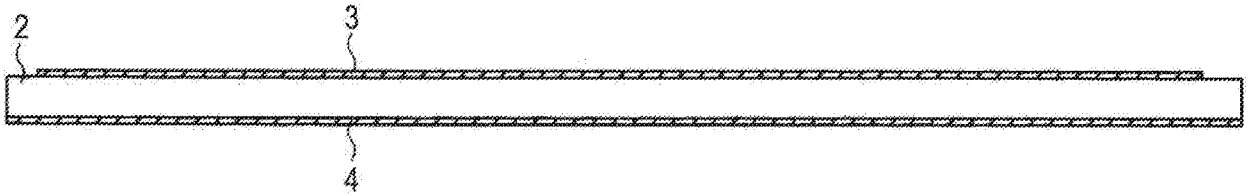

FIGS. 12A and 12B illustrate another example of an array antenna 7' according to Embodiment 2 of the present disclosure. FIG. 12A is a plan view of the array antenna 7', and FIG. 12B is a cross-sectional view taken along the line XIIB-XIIB in FIG. 12A.

Elements identical to those in FIGS. 3A and 3B are given identical reference numerals, and detailed description thereof is omitted. Four antenna elements 5*a*, 5*b*, 5'*c*, and 5'*d* provided close to an input terminal 6 in the array antenna 7' illustrated in FIGS. 12A and 12B are different from those in FIGS. 3A, 6A, and 11A.

Specifically, in the array antenna 7 illustrated in FIGS. 11A and 11B, the second antenna element and the third antenna element are alternately provided at positions close to the input terminal 6. In the array antenna 7' illustrated in FIGS. 12A and 12B, two second antenna elements (antenna elements 5*a* and 5*b*) are provided at positions close to the input terminal 6, and two third antenna elements (antenna elements 5'*c* and 5'*d*) are provided at positions far from the input terminal 6 than the antenna element 5*b*.

The array antenna 7' illustrated in FIGS. 12A and 12B can radiate a radio wave of a desired beam pattern whose side lobe is suppressed as in the array antenna 7 illustrated in FIGS. 11A and 11B. Furthermore, the array antenna 7' can further reduce the influence of radio waves radiated from the second antenna element and the third antenna element on frequency characteristics of radio waves radiated from the whole array antenna, as in the array antenna 7 illustrated in FIGS. 11A and 11B.

In the present embodiment, a case where antenna elements having different radii are disposed has been described. However, the present disclosure is not limited to this. For example, an antenna element having a cutout part whose width G is large and an antenna element having a cutout part whose width G is small may be disposed as described in Variation 1 of Embodiment 1. Alternatively, an antenna element whose width W is large and an antenna element whose width W is small may be disposed as described in Variation 2 of Embodiment 1.

In the embodiments described above, an arrangement in which resonant frequencies of four antenna elements provided close to an input terminal are changed has been described. However, the present disclosure is not limited to this. The present disclosure can be applied to an antenna element provided at any position, and thus the amount of radiation of the antenna element can be adjusted.

In the embodiments described above, an antenna element has a loop shape having a cutout part. However, the present disclosure is not limited to this. The present disclosure can be applied to an antenna element of any shape provided that the antenna element is electromagnetically coupled with a feed line and the resonant frequency thereof can be adjusted, and thus the amount of radiation of the antenna element can be adjusted.

An array antenna according to the present disclosure can be used for an on-board radar and the like.

What is claimed is:

1. An array antenna for radiating a radio wave at a first frequency, the array antenna comprising:

a feed line that is provided on a first surface of a substrate; and a plurality of antenna elements that are provided on the first surface at predetermined gaps along the feed line and that are electromagnetically coupled with the feed line, wherein each of the plurality of antenna elements is shaped in a loop having a cutout part, each of the plurality of antenna elements includes a first portion and a second portion opposite to the first portion, the first portion of each of the plurality of antenna elements is a portion that is closest to the feed line and spaced away from the feed line, the second portion of each of the plurality antenna elements is a portion that is furthest away from the feed line, the cutout part of each of the plurality of antenna elements is arranged at a position other than the first portion and the second portion of each of the plurality of antenna elements, the plurality of antenna elements include one or more first antenna elements and one or more second antenna elements, the first antenna element is shaped to resonate at the first frequency, and the second antenna element is shaped to resonate at a second frequency that differs from the first frequency by a predefined amount.

2. The array antenna according to claim 1, wherein the first frequency is a frequency of radio waves radiated by the plurality of antenna elements.

3. The array antenna according to claim 1, wherein a radius of the first antenna element is different from that of the second antenna element.

4. The array antenna according to claim 1, wherein a size of the cutout part of the first antenna element is different from that of the cutout part of the second antenna element.

5. The array antenna according to claim 1, wherein a width of the first antenna element in a radius direction is different from that of the second antenna element in the radius direction.

6. The array antenna according to claim 1, wherein the second antenna element is provided at a position at which an amount of radiation that is not more than 2% of a whole amount of radiation radiated from the plurality of antenna elements is required.

7. The array antenna according to claim 1, wherein the plurality of antenna elements are provided so that the second antenna element is closer to a feeding point and the first antenna element is farther from the feeding point than the second antenna element.

8. The array antenna according to claim 1, wherein the plurality of antenna elements further a include one or more third antenna elements having a shape that resonates at a third frequency different from the first frequency and the second frequency;

the first frequency is a frequency between the second frequency and the third frequency; and an absolute value of a difference between the first frequency and the second frequency is substantially equal to that of a difference between the first frequency and the third frequency.

9. The array antenna according to claim 8, wherein the second antenna element and the third antenna element are alternately provided in a line along the feed line.

10. The array antenna according to claim 8, wherein the number of the second antenna elements is the same as the number of the third antenna elements.

11. The array antenna according to claim 1, wherein the cutout part of each of the plurality of antenna elements is located so that an angle formed by (i) a straight line connecting a center of the each of the plurality of antenna elements and a substantial center of the cutout part and (ii) the feed line is 45 degrees.

12. The array antenna according to claim 1, wherein the second antenna element radiates, when the array antenna is driven by the first frequency, an amount of power lower than an amount of power radiated by the first antenna element.

* * * * *